US012691329B1

(12) United States Patent
Ball et al.

(10) Patent No.: US 12,691,329 B1
(45) Date of Patent: Jul. 28, 2026

(54) HEALTHY POSTURE SYSTEM AND METHOD

(71) Applicants: Todd Ball, St. Augustine, FL (US); Jennifer Ball, St. Augustine, FL (US)

(72) Inventors: Todd Ball, St. Augustine, FL (US); Jennifer Ball, St. Augustine, FL (US)

( * ) Notice: Subject to any disclaimer, the term of this patent is extended or adjusted under 35 U.S.C. 154(b) by 129 days.

(21) Appl. No.: 18/828,765

(22) Filed: Sep. 9, 2024

Related U.S. Application Data

(60) Provisional application No. 63/581,361, filed on Sep. 8, 2023.

(51) Int. Cl.

| | |
|---|---|
| ***A63B 23/02*** | (2006.01) |
| ***A63B 21/00*** | (2006.01) |
| ***A63B 21/08*** | (2006.01) |
| ***A63B 23/025*** | (2006.01) |
| *A63B 23/00* | (2006.01) |

(52) U.S. Cl.
CPC .... *A63B 23/0238* (2013.01); *A63B 21/00185* (2013.01); *A63B 21/08* (2013.01); *A63B 23/0244* (2013.01); *A63B 23/025* (2013.01); *A63B 2023/006* (2013.01)

(58) Field of Classification Search
CPC ..... A63B 23/0238; A63B 21/00185; A63B 21/08; A63B 23/0244; A63B 23/025
USPC ..... 340/573.7
See application file for complete search history.

(56) References Cited

U.S. PATENT DOCUMENTS

| | | | | |
|---|---|---|---|---|
| 5,868,691 | A * | 2/1999 | Vishnevsky | A61F 5/026 128/845 |
| 2003/0220591 | A1* | 11/2003 | Gladoun | A63B 21/00054 600/594 |
| 2008/0102425 | A1* | 5/2008 | Brandon | A61B 5/4561 434/247 |
| 2013/0201021 | A1* | 8/2013 | Limonadi | A63B 21/0407 340/573.7 |
| 2014/0194260 | A1* | 7/2014 | Campanaro | A63B 21/4043 482/131 |
| 2021/0205112 | A1* | 7/2021 | Craytor | A61F 5/026 |

OTHER PUBLICATIONS

Brown, Albert, Prehab for Regenerative Medicine for Neck Pain, Jul. 13, 2023, Healthy Posture Club, https://healthypostureclub.com/prehab-for-regenerative-medicine-for-neck-pain/ (Year: 2023).*
Prehab for Regenerative Medicine for Neck Pain (Year: 2023).*

* cited by examiner

*Primary Examiner* — Kerri L Mcnally
(74) *Attorney, Agent, or Firm* — Spencer Fane, LLP

(57) ABSTRACT

A healthy posture method. Joint clearing is performed to attain neutral spine alignment during at least one static posture. Neutral spine alignment is where a force of the patient's body is distributed substantially evenly through each spinal vertebra. Load tolerance is strengthened by performing functional tasks against light load tolerances. Functional conditioning is performed to strengthen load tolerance by performing functional tasks against light to moderate load tolerances. Functional conditioning is performed to strengthen load tolerance by performing functional tasks against moderate load tolerances. Each of the steps is performed using neutral spine alignment.

19 Claims, 14 Drawing Sheets

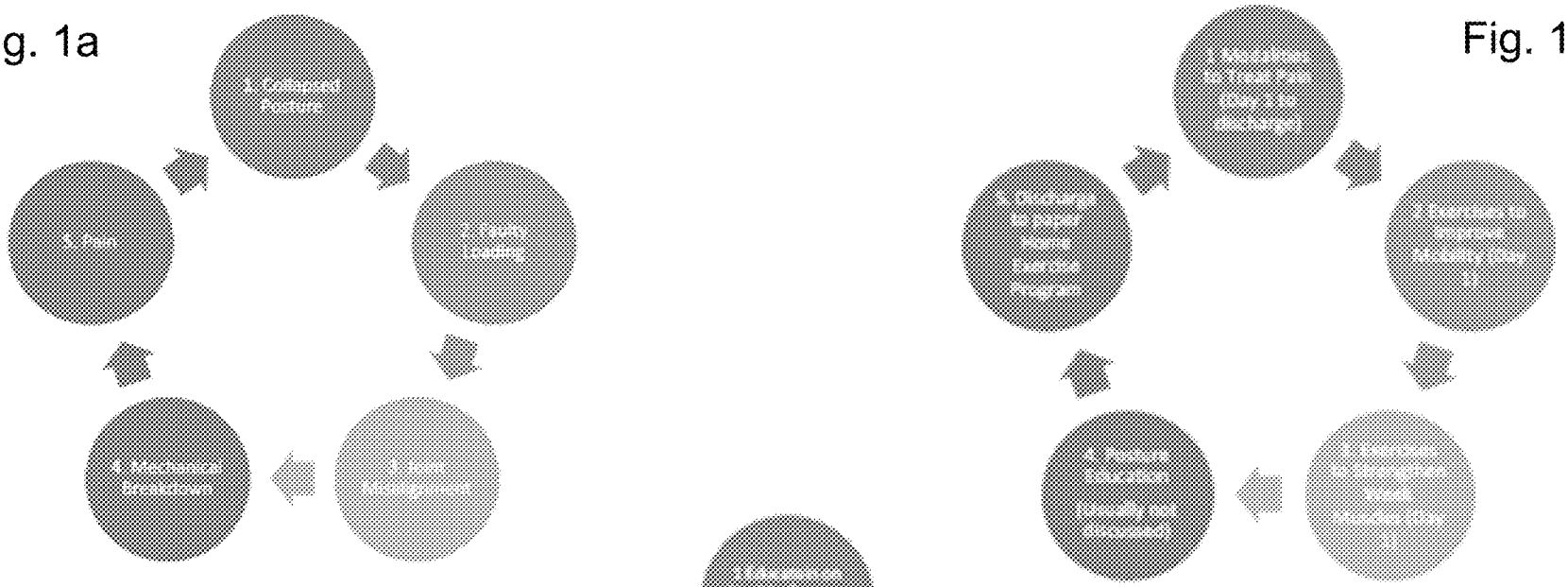
Fig. 1a
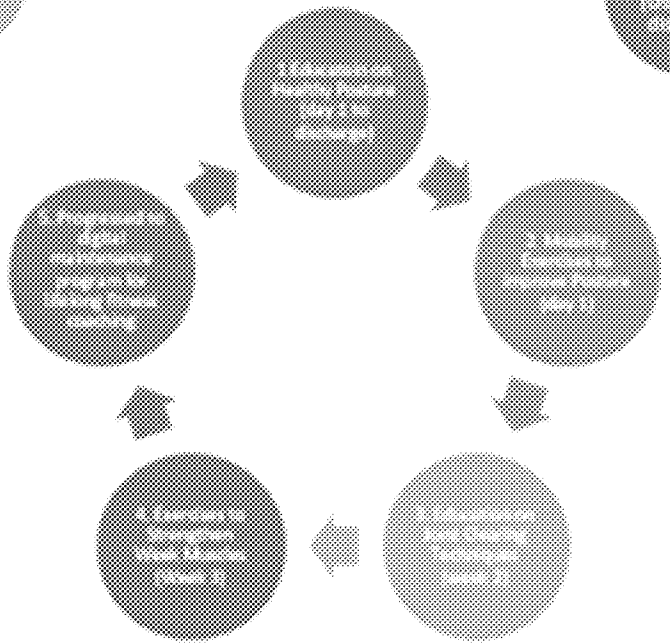
Fig. 1b
Fig. 1c

- Mobility Loss
  = level 2 functional mobility workout for that body part (0-10 scale)
- Pain
  = level 2 functional mobility workout for that body region (0-10 scale)
- Strength Loss
  = level 3 functional mobility for that body region (0-10 scale)
- Level 4 Workout
  = level 4 functional mobility for that body region (0-10 scale)

Lower Body Conditioning:

| Pelvic Curls - Level 1 | Pelvic Curls - Level 2 | Pelvic Curls - Level 3 | Pelvic Curls - Level 4 |
|---|---|---|---|
| ☐ Unabl to get into neutral | ☐ Unabl to get into neutral | ☐ Unabl to get into neutral | ☐ Unabl to get into neutral |
| ☐ Able to get into neutral | ☐ Able to get into neutral | ☐ Able to get into neutral | ☐ Able to get into neutral |
| ☐ Able to flex L5/S1 | ☐ Able to flex L5/S1 | ☐ Able to flex L5/S1 | ☐ Able to flex L5/S1 |

- Healthy SI/Hip Program
  - Level 1 SI Stability Exercise – bridging with magic circle
  - Level 2 SI Stability Exercise – Prone knee flexion with magic circle
  - Level 3 SI Stability Exercise – Sidelying magic circle
- Healthy Knee Program
  - Level 1 Knee Stability Exercise – bilateral pelvic curls off ball and straight leg raises.
  - Level 2 Knee Stability Exercise – single leg pelvic curls off ball and seated knee extension with kettlebell
  - Level 3 Knee Stability Exercise – leg lifts from plank off ball

Fig. 9

Upper Body Conditioning:

| Plank Series - Level 1 | Plank Series- Level 2 | Plank Series - Level 3 | Plank Series - Level 4 |
|---|---|---|---|
| | | | |
| ☐ Unable to get into neutral | ☐ Unable maintain neutral on R | ☐ Unable to get into neutral | ☐ Unable to get into neutral |
| ☐ Able to get into neutral | ☐ Unable maintain neutral on L | ☐ Able to get into neutral | ☐ Able to get into neutral |
| ☐ Able to hold neutral for 8 sec. | ☐ Able to maintain Chest Lift* | ☐ Able to hold neutral for 8 sec. | ☐ Able to hold neutral for 8 sec. |

* Healthy Shoulder Program
  - Level 1 Shoulder Stability Exercise – Isometric ER with magic circle
  - Level 2 Shoulder Stability Exercise – Sidelying ER
  - Level 3 Shoulder Stability Exercise – Standing ER

Fig. 10

Lower Body Conditioning:

Walking Series aka inward spiral series

- L1 - 4 Standing Marches leaning into wall
- L2 - 4 Step-ups leaning into wall
- L3 - 4 Marches + Step-ups with arms across your chest
- L4 - 4Marches + Step-ups holding foam roller or 5 lb. bar in overhead Y-position

Squat Series aka eccentric quad series

- L1 - 4 Squats with arms across chest
- L2 - 4 Squats with reverse curl-up or overhead lift with roller or exercise bar
- L3 - 4 Squats maintaining overhead Y-press with roller or exercise bar
- L4 - 4 sustained squat spine twists

Lunge Series

- L1 - 4 Lunges performing a reverse curl-up with roller or exercise bar as counter balance
- L2 - 4 Lunges with arms across chest on both legs
- L3 - 4 Lunges maintaining overhead Y-press with roller or exercise bar on both legs
- L4 - 4 sustained lunge spine twists on both legs

Fig. 11

Upper Body Conditioning:

Chest Lift, Series aka plank series

- L1 - 8 sec. hold in neutral spine on all 4's position (quadruped position)
  - L2 - 4 alternating arm floats maintaining neutral spine alignment in quadruped position with dowel stick
  - L3 - 8 sec. plank on knees hold maintaining neutral spine and hip alignment with dowel stick
  - L4 - 8 sec. plank on toes hold maintaining neutral spine and hip alignment with dowel stick

Head Nod, Series aka prone arm lift series

- L1 - 4 arm lifts with arms by your side maintaining neutral spine alignment
  - L2 - 4 arm lift with arm in goal post position (90/90 position) maintaining neutral spine alignment
  - L3 - 4 alteranting arm floats with arms in overhead Y-position maintaining neutral spine alignment and full elbow extension
  - L4 - 4 alternating arm + opposite leg lifts from overhead Y-position maintaining neutral spine alignment

Overhead Lifting

- L1 - 4 2-part foam roller or 5 lb. exercise bar lifts
  - L2 - 4 1-part foam roller or 5 lb. exercise bar lifts
  - L3 - 4 2-part kettlebeel presses in scapular plane; 4 in diagonal plane
  - L4 - 4 kettlebeel swings in scapular plane; 4 in diagonal plane

Fig. 12

1. Joint Clearing Techniques

| | Standing March Screen | | Squat Screen | |
|---|---|---|---|---|
| | PT/PTA | NSCS | PT/PTA | NSCS |
| L1 | If pelvis hikes with balance support perform the level 1 - 3 LBJCR. Review Pelvic Curls to level 2 if appropriate + time permits. | Hip Hikes with balance support; perform L1 LBJCR f/b L1 LBC workout. | If there is a bias to the L or R despite verbal cues, perform the level 1 - 3 LBJCR including ankle correction. | with bias to the R or L despite vc's; perform L1 LBJCR + knee + ankle f/b L1 LBC workout |
| L2 | If pelvis hikes w/o balance support perform the level 1 + 2 LBJCR. Review Pelvic Curls to level 3 if appropriate + time permits. | If the hip hikes without balance support; perform L2 LBJCR f/b L2 LBC workout. | If pelvis hikes without balance support perform the level 1 + 2 LBJCR. Review walking series to level 2 if appropriate + time permits. | + with bias to the R or L but responded to vc's; perform L2 LBJCR + ankle f/b L2 LBC workout. |
| L3 | If negative, perform the workouts based on the clients leveling. Level 3+ workout are appropriate. | | | |

2. Neutral Spine Conditioning + Functional Fitness Exercises

| | Pelvic Curl® Series | Curl up Series | Squat Series | Lunge Series |
|---|---|---|---|---|
| L2 | Able to unload pelvis w/o rib flare | Able to lift skull off yoga block w/o losing HN | Able to maintain NSA throughout squat | Able to maintain NSA at bottom of lunge |
| L3 | unload pelvis without firing glutes | lift sternum off yoga block w/o losing HN | maintain NSA throughout squat | maintain NSA throughout lunge |
| L4 | unload pelvis w/o losing Head Nod (HN) | lift rib cage off yoga block w/o losing HN | Able to maintain NSA throughout squat | maintain NSA throughout lunge |
| L5 | unload pelvis w/o losing HN | maintain curl up for 8 sec w/o losing HN | maintain 12 sec. squat w/o losing NSA | maintain 12 sec. lunge w/o losing NSA |

Fig. 13

Upper Body Conditioning:

1. Joint Clearing Techniques

| | Chest Lift Screen | | Overhead Lifting Screen | |
|---|---|---|---|---|
| | PT/PTA | NSCS | | |
| L1 | Perform complete upper quarter screen. | Unable to get into Ches Lift due to pain. Review a level 1 lower body workout and schedule injury severity screen with PT. | Perform complete upper quarter screen. | Unable to get lift arm overhead due to pain; review a level 1 lower body workout and schedule injury severity screen with |
| L2 | If unable to get into Ches Lift due to mobility perform level 1 - 3 UBJCR. Review Chest Lift Series to level 2 if appropriate + time permits. | Unable to get into Ches Lift due to mobility; perform Ches Lift stretch + back massage f/b L1 UBC workout. | If scapulae elevate despite vc's perform level 1 - 3 UBJCR. Review Side Planks to level 2 if appropriate + time permits. | R or L scapulae elevates despite vc's; perform L1 UBJCR including 1st rib + Sh f/b L1 UBC workout |
| | If can't maintain Chest Lift with spine twist perform the level 1 + 2 UBJCR. Review Chest Lift Series to level 3 if appropriate + time. | can't maintain Chest Lift with spine twist; perform L2 JCR f/b L2 UBC workout. | If scapulae elevate but responds to vc's perform level 1 + 2 UBJCR. Review Chest Lift Series to level 3 if appropriate + time. | R or L scapulae elevates but responds to vc's; perform L2 UBJCR including 1st rib f/b L2 UBC workout. |
| L3 | If negative, perform the workouts based on the clients leveling. Level 3+ workout are appropriate. | | | |

2. Neutral Spine Conditioning + Functional Fitness Exercises

| | Chest Lift Series | Head Nod Series | Walking Series | Overhead Lifting Series |
|---|---|---|---|---|
| L2 | able to hold NSA for 8 sec. | 4 bilat. arm lifts from neutral w/o losing NSA | Able to perform 4 alt. marches with balance support w/o losing NSA | Able to lift foam roller with 2-part + 1-part strategy w/o losing NSA or rib flare |
| L3 | perform 4 alt. arm floats w/o losing NSA | 4 bilat. arm lifts from 90/90 losing NSA | 4 alt. step-ups w/ balance support w/o losing NSA | Able to lift 5-9 lb. exercise bar with 2-part strategy w/o losing NSA or rib flare |
| L4 | maintain NSA for 12 sec. plank on knees | 4 alt. arm lift from overhead Y w/o losing NSA | 4 marches + step-ups w/o balance support | press 3-5 lb. kettle bell w/o losing NSA |
| L5 | maintain NSA for 12 sec. plank on toes | 4 opposite arm + leg lifts without losing NSA | 4 marches + step-ups holding overhead Y | swing 3-5 lb. kettle bell w/o losing NSA |
| L6 | perform 4 alt. leg lifts w/o losing NSA | 4 bilateral overhead lifts without losing NSA | 4 marches + step-ups holding overhead Y with kettlebell | Able to maintain neutral scapular positioning with overhead triceps |

Fig. 14

HEALTHY POSTURE SYSTEM AND METHOD

REFERENCE TO RELATED APPLICATION

This application claims priority to Provisional Applic. No. 63/581,361, filed Sep. 8, 2023, the contents of which are incorporated herein by reference.

FIELD OF THE INVENTION

The invention relates generally to a human musculoskeletal development system and method for treating mechanical musculoskeletal pain digitally. More particularly, the invention relates to a healthy posture system and method of reverse engineering for treating musculoskeletal pain associated with faulty posture.

BACKGROUND OF THE INVENTION

It is estimated that 75 percent of the workforce in the United States has bad posture, that 50 percent of the workforce in the United States currently has musculoskeletal pain and that 50 percent of the remaining workforce in the United States will experience musculoskeletal pain in the next 3 months.

Bad posture is when the upper back is so collapsed that facet loading in the upper and lower cervical spine is the primary source of stability in the neck and L5/6 facet loading is the primary source of stability in the lower lumbar spine. Movement from bad posture causes mechanical overload in these segments of the spine and results in asymmetrical loading of the shoulder, hips and knees. Bad posture causes joint misalignment which accelerates joint breakdown and is the primary source of most musculoskeletal pain conditions.

Technology has us spending a majority of our day in collapsed postures with asymmetrical loading through the spine. These asymmetrical loading patterns cause muscle tension imbalances that over time result in joint misalignment in the lower lumbar spine, lower cervical spine and upper cervical spine.

Collapsed posture over time fixates the skull in front of the rib cage (forward head posture) out of its neutral positioning on C1 which results in excessive facet loading in the cervical spine. So as not to fall forward the musculoskeletal system collapses the pelvis forward to arch the low back keep us upright. This results in excessive facet loading in the lumbar spine. The facet joints are designed to guide motion, they are not designed for load transfer or support. Collapsed posture is accelerating the breakdown of our spines, specifically the C5/6 and L5/S1 vertebral segments. Forward head posture is stretching out the ligaments of the upper cervical spine and compromising blood flow to the brain.

These joint misalignments cause more muscle imbalances and abnormal holding tension that restricts blood flow which causes pain. At a certain level of vertebral misalignment, the nerves that exit these vertebrae at these transition joints can become compressed.

At this point, we then stop using our bodies efficiently. Everything we do at this level of misalignment strengthens the faulty loading patterns causing our misalignments, joints start breaking down and we are at a higher risk of injury.

Those who function from good posture (neutral spine alignment) have symmetrical loading through the spine, hips, knees and shoulders. These people are less susceptible to repetitive use injuries and are experience significantly less musculoskeletal pain and have higher energy levels. Additionally, when they do suffer an injury, they are able to be more aggressive in treating the injury because they are neurologically conditioned to position their joints in optimal positioning for healing. Applying reverse engineering, we have developed a neutral spine based functional conditioning program that restores the ability to perform traditional fitness exercises from healthy posture to promote healthy aging, self-guided injury management and injury prevention.

SUMMARY OF THE INVENTION

An embodiment of this invention relates to a healthy posture system and method that incorporate joint clearing techniques built into a neutral spine based functional fitness workouts to treat the foundation of musculoskeletal pain that is associate with faulty posture. Instead of treating pain symptoms, we apply reverse engineering to the problem and address it at its source, joint misalignment caused by collapsed upper back posture. This system of neutral spine conditioning before starting fitness training replaces strengthening from faulty posture with strengthening from neutral spine alignment as a method of breaking this cycle of faulty asymmetrical loading during fitness or rehabilitation. The Healthy Posture System is a digital physical therapy program that combines joint clearing techniques with 6 levels of neutral spine conditioning to address the foundation of musculoskeletal pain associated with collapsed upper back posture. The Functional Mobility Phase (Level 1) restores access to neutral spine alignment. Neutral spine alignment is defined as when your skull, rib cage and pelvis are in alignment with each other in all three planes of motion. Healthy posture restores healthy loading through the vertebral bodies and unloads the facet joints. This allows for equal transfer of load, maximum balance and movement control. Movement from healthy posture restores healthy loading through the spine as well as symmetrical loading through the shoulders, hips and knees. The Neural Integration Phase (level 2) challenges the ability to perform basic functional movements (getting out of a chair or lifting overhead) without losing neutral spine alignment. The Neutral Spine Conditioning Phase (level 3) of the program starts strengthening the muscles the keep you in neutral spine alignment. Joint clearing techniques are added to the workout to restore neutral joint positioning before strengthening exercises to break faulty loading patterns that are contributing to pain. At this point any functional conditioning exercise performed has the potential of replacing faulty loading patterns with symmetrical loading patterns for long term injury management and prevention. We start adding light resistance to functional exercises performed bilaterally to further strengthen neural integration for movement from neutral spine alignment.

During the Functional Conditioning Phase (level 4) we progress to unilateral strengthening exercises and increase resistance as tolerated to replace faulty asymmetrical loading patterns during functional tasks with the ability to perform those tasks from neutral spine alignment to ensure symmetrical loading through all joints involved in that movement. Participants with active pain conditions no longer require medical supervision at this level of care. At levels 4 and 5 of the program clients are performing the same rehabilitation exercises as traditional models but with their nervous system conditioned to do so from neutral spine alignment and within a fitness system the restores neutral joint positioning before strengthening every exercise, every workout. Resistance, repetitions and tempo are increased to tolerance during the Functional Fitness Phase (level 5) of the Health Posture System to condition the nervous system for a safe return to fitness level conditioning. Resistance, repetitions and tempo are increased to tolerance during the Functional Fitness Phase (level 6) of the Health Posture System to condition the nervous system for a safe return to sport and recreational activities without faulty (asymmetrical) loading patterns.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 1*a* illustrates a typical pathway to musculoskeletal pain.

FIG. 1*b* illustrates treatment of musculoskeletal pain treatment using conventional treatment methods.

FIG. 1*c* illustrates treatment of musculoskeletal pain treatment using this invention.

FIG. 9 illustrates the use of the neutral spine conditioning workstation in conjunction with lower body conditioning.

FIG. 10 illustrates the use of the neutral spine conditioning workstation in conjunction with upper body conditioning.

FIG. 11 illustrates the use of the functional conditioning workstation in conjunction with lower body conditioning.

FIG. 12 illustrates the use of the functional conditioning workstation in conjunction with upper body conditioning.

FIG. 13 criteria for progression for lower body conditioning.

FIG. 14 criteria for progression for upper body conditioning.

DETAILED DESCRIPTION OF THE INVENTION

Figure 2:
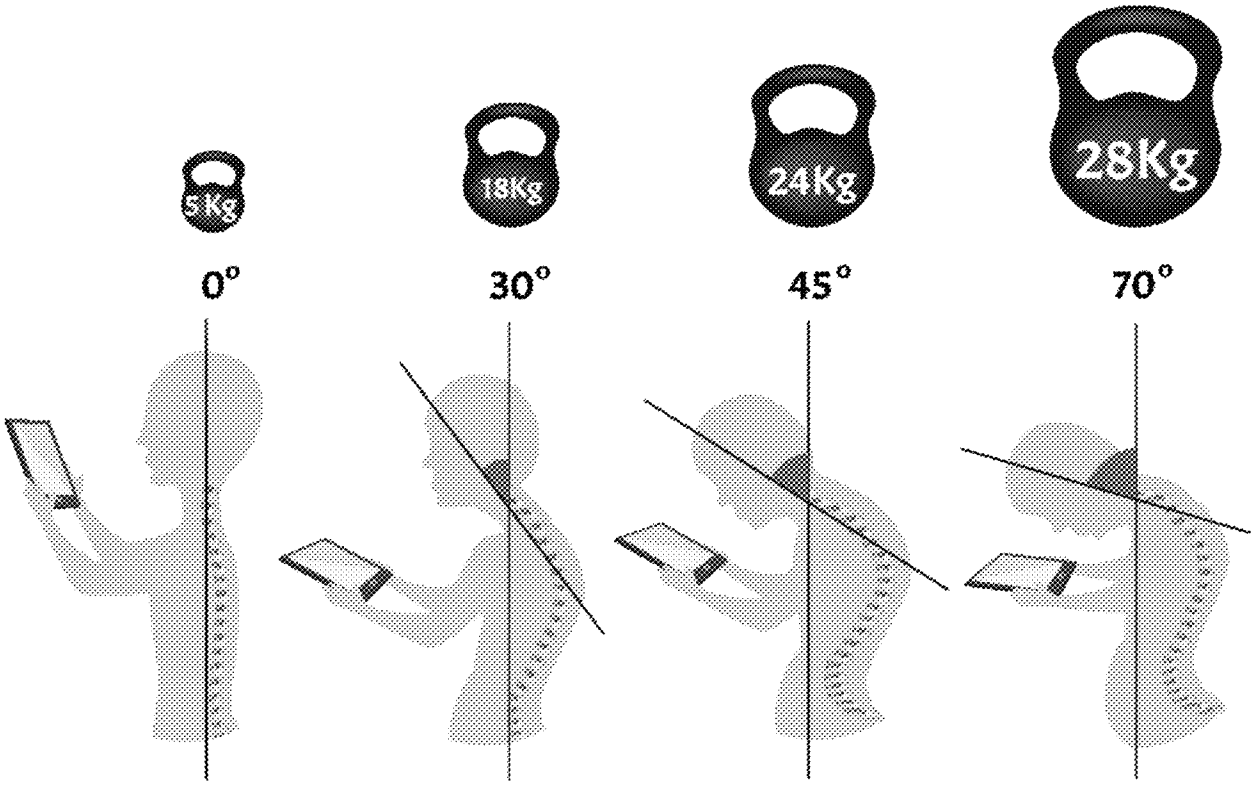
FIG. 2 illustrates differing levels of posture collapse.

An embodiment of the invention is directed to a system and method of treating posture oriented musculoskeletal pain using neutral spine-based functional fitness program with multiple levels of progression that allows the nervous system sufficient time and movement milestones to remodel itself for movement from healthy posture.

Faulty musculoskeletal loading is a result of faulty joint alignment, which is a common cause of musculoskeletal pain. For example, joint misalignment can result from collapsed upper back posture. As aspect of the invention includes evaluating whether the musculoskeletal pain is the result of faulty joint alignment.

An embodiment of the invention includes the following phases:

- Phase 1-mobility exercises to restore access to neutral spine alignment
- Phase 2-upper body conditioning workout and lower body conditioning workout that are performed daily to increase endurance for maintaining neutral spine alignment against light neutral spine conditioning loads
- Phase 3-upper body conditioning workout and lower body conditioning workout performed bi-weekly to increase endurance for maintaining neutral spine alignment against moderate neutral spine conditioning loads and that includes joint clearing techniques that enhance the ability to perform each exercise with all joints involved in the movement while maintaining neutral joint positioning through the movement.
- Phase 4-upper body conditioning workout and lower body conditioning workout that is performed on alternating days to increase endurance for maintaining neutral spine alignment against moderate to heavy neutral spine conditioning loads In certain embodiments, the invention uses equipment to maintain neutral spine alignment while performing the techniques. Examples of the equipment include dowel sticks, force plates, wearables, progressive support blocks and a spine aligner stick.

The patient cannot restore healthy loading patterns through the cervical spine and lumbar spine until the patient can stack the upper back into the chest lift posture. Any strengthening done without chest lift posture reinforces the faulty loading patterns in the neck and back that contribute to the joint misalignment that cause most musculoskeletal pain conditions in the neck, shoulder and back.

The chest lift and the head nod reverse forward head posture to avoid reinforcing faulty loading patterns that contribute to joint misalignment and results in pain The chest lift is when the lower trapezius slide the shoulder blades down the rib cage into a neutral position. This motion results in upper thoracic spine extension.

Once the patient can stack the upper back in a way that repositions the skull on top of the rib case, the patient can begin performing exercises to restore facet loading in the cervical spine through the use of a head nod. The head nod should not be added until the patient can stack the upper back into the chest lift posture.

The combination of the chest lift and the head nod restores healthy cervical spine loading by transferring weightbearing from the facet joints to the vertebral bodies of the cervical spine vertebrae, which are designed to provide load transfer and support.

The head nod is when the skull translates posteriorly on the C1 vertebrae into a neutral position. This motion results in upper cervical spine flexion.

The next step is for the patient to add a seated 2-part overhead arm lift exercise to strengthen the patient's ability to maintain the chest lift and head nod posture functionality. Prescribing level 2 of the functional integration workout provides the patient with a safe self-care exercise to continue the neutral spine conditioning program.

Once the patient is able to retain the spine in neutral alignment, it is possible to position the pelvis under the rib cage to retore healthy lumbar spine loading by transferring weight bearing from the facet joints to the vertebral bodies of the lumbar spine vertebrae, which are designed for load transfer and support. Facet joints are designed to guide alignment and not for load transfer or support.

It is not possible to restore healthy loading through the lumbar spine until the pelvis is in neutral spine alignment using a pelvic curl. However, it is not possible to do a pelvic curl until the patient can stack the upper back into the chest lift posture.

Pelvic curl is when the lower abdominal suspends the pelvis into a neutral position. This motion results in lower lumbar spine flexion, which restores healthy loading in the lower lumber spine.

If strengthening exercises are performed without the pelvis in the neutral position, the faulty loading patterns are reinforced, which contributes to joint misalignment and results in pain in the back, hips, knees and ankles.

After week 1 of doing the level 3 neural integration hourly mobility program, the patent is ready to start daily workouts that combine functional mobility exercises with joint clearing exercises to prepare the patient to perform neutral spine conditioning exercises with access to neutral spine alignment. The neutral spine conditioning exercises are designed to strengthen the patient's ability to perform and maintain neutral spine alignment during functional conditioning exercises. All prescribed functional conditioning exercises match the level of neutral spine conditioning that correlate to the workout at each level.

The next step in the progression of the patient is to add a standing march exercise with balance support (such as leaning against a wall) to strengthens the ability to maintain the pelvic curve posture functionally and thereby provide a safe self-care exercise to continue neutral spine conditioning program.

The patient cannot restore healthy loading through the hips, knees and ankles until the patient restores neutral femoral head positioning in the hip socket through chest lift and pelvic curl. This is achieved through doing an inward spiral where the hip internal rotator muscles rotate the femoral head into its neutral position within the acetabulum. This motion results in hip internal rotation, which pulls us out of lateral loading of the hips, knees and ankles.

Once the patient is able to attain neutral alignment of spine and hips, the patient can start learning how to position the femoral head in the neutral alignment position to restore healthy hip and knee loading during dynamic activities such as walking, squatting, lunging and climbing stairs.

The next step in the progression of the treatment is adding standing march exercise without balance support and squats with strengthen the patient's ability to maintain pelvis curl functionality.

Any strengthening exercises that are done without the femur in its neutral position with respect to the hip socket reinforces faulty loading patterns, which contributes to joint misalignment and results in musculoskeletal pain in the back, hips, knees and ankles.

When the patient is able to maintain neutral spine alignment for 8 repetitions of each exercise in the level 1 conditioning workout, the patient can add lunges to the lower body workout with balance support and plank on knees to the upper body conditioning workout.

One indication of the patient progressing in the treatment program is that it is possible for the patient to replace faulty loading patterns with healthy movement if the last 4 repetitions of every exercise are performed from neutral spine alignment.

The patient should not start functional strengthening against resistance until the patient is able to maintain neutral spine alignment against light to moderate loads and has a mechanism for restoring neutral joint positioning of any hypermobile joint and that must be performed successfully before strengthening exercises to ensure that each repetition is done with healthy loading through the joint.

After 1 week of the neutral spine conditioning workout, the patient should have sufficient neutral integration and neutral spine conditioning to progress to level 2 of the neutral spine conditioning workout.

When the patient is able to perform each exercise of the level 4 workout without losing neutral spin alignment or needing cueing for proper form, the patient is able to safely progress to the level 5 workouts. At this level, it is safe to prescribe level 1 joint clearing techniques to better position the upper back, pelvis and should blades into their neutral positioning before strengthening.

Joint clearing techniques may be included in start your day routine to ensure unobstructed access to neutral spine alignment throughout each day. The joint clearing techniques are included in each workout to ensure strengthening exercises are performed through neutral positioned joints. These exercises include upper body workouts and lower body workouts.

Joint clearing techniques safely clear muscular holding patterns that limit functional mobility in the direction opposite of a misalignment. The joint clearing techniques are designed to reposition a hypermobile joint that has a tendency to come out of alignment into a more neutral position prior to performing strengthening exercises.

After performing 72 hours of the neutral spine conditioning program, the patient should be able to perform about 33 percent of their home and sedentary work tasks from neutral spine alignment.

When the patient is able to perform 8 repetitions of each exercise in the level 5 workout without losing neutral spine alignment or the need for verbal cues, the patient is able to progress to level 5 workouts.

When the patient is able to perform each exercise of the level 5 workout without losing neutral spine alignment or needing cueing for proper form, the patient is able to safely progress to the level 6 workouts. At this level, joint clearing techniques can safely be prescribed to better position the first rib, shoulder and hips into their neutral positioning before strengthening.

After 1-2 weeks of the patient performing the neutral spine conditioning program, the patient should be able to perform greater than 50 percent of their home and sedentary work tasks from neutral spine alignment.

The patient cannot restore symmetrical loading through the hips and knees dynamically until the patient can maintain neutral hip positioning (inward spiral) through the lunge.

Fitness level strengthening against resistance for anyone with a hypermobile joint should not be initiated until the patient can maintain neutral spine alignment during squats, lunges, stair climbing and overhead lifting.

When the patient is able to perform each exercise of the level 6 workout without losing neutral spine alignment or needing cueing for proper form, the patient can progress to the level 7 workouts. At this point, the level 3 joint clearing techniques can be safely added to better position the C1 vertebra, the L5 vertebra and fibulae into their neutral position before strengthening.

At this level of neutral spine conditioning, the patient can transition back into most pre-injury fitness workouts with sufficient neutral spine conditioning to perform these activities without faulty loading patterns.

After 2-4 weeks of the level 7 workouts, the patient should be abler to perform at least 66 percent of their home and sedentary work tasks from neutral spine alignment. Additionally, after 2-4 weeks of the level 7 workouts, the patient should be able to perform isokinetic strengthening exercises at the gym without losing neutral spine alignment.

When the patient is able to perform each exercise of the level 7 workouts without losing neutral spine alignment or needing cueing for proper form, the patient is able to safely progress to the level 8 workouts. At this level, level 4 joint clearing techniques can safely be done to better position the C1 vertebra, the L5 vertebra and fibulae into their neutral positioning before strengthening.

After 4 weeks of the level 8 workouts, the patient should be able to perform at least 75 percent of their home and sedentary work tasks from neutral spin alignment. Additionally, after 4 weeks of the level 8 workouts, the patient should possess sufficient neutral spine conditioning to safely perform isotonic strengthening exercises at the gym without losing neutral spine alignment. As such, the patient can start easing back into most pre-injury sport and recreational activities with sufficient neutral spine conditioning to perform these activities without faulty loading patterns.

After completing the invention, the patient will be at less risk for reinjury because the invention addresses the foundation of the program and not the symptoms. Additionally, after completing the invention, the patient will be significantly less likely to suffer a repetitive motion injury as a result of the neutral spine-based functional conditioning. After completing the invention, the patient will also have a lower fall risk because the patient will have much more control and a quicker musculoskeletal reaction time as a result of the neutral spine-based functional conditioning. The neutral spine-based functional conditioning will also enable the patient to recover quicker from future musculoskeletal injuries.

An embodiment of the invention is directed to a healthy posture system and method that includes a series of workout techniques that are combined with lifestyle modification and coaching to restore the ability to perform daily tasks from neutral spine alignment.

Neutral spine alignment is when the skull, rib cage and pelvis are in their neutral relationships with each other to restore vertebral body loading throughout the entire spine. Only from neutral spine alignment can the shoulder, hips and knees load symmetrically.

Each workout within the invention combines functional mobility exercises and joint clearing techniques with neutral spine conditioning and functional fitness exercises for a complete workout. There are 9 levels of neutral spine conditioning within the invention to ensure a strong foundation for healthy movement is established.

This invention addresses the foundation of the collapsed posture. Joint clearing techniques are an integral part of the system to break the faulty loading patterns that cause joint misalignment. A joint clearing technique is when the person mobilizes a joint that is out of alignment back in alignment by moving the body in the opposite direction as the misalignment. This process allows us to treat the foundation of musculoskeletal pain digitally. The invention replaces manual therapy with the addition of joint clearing techniques at level 3 of the program.

FIG. 1*a* illustrates a typical pathway to musculoskeletal pain that begins with a collapsed posture, which leads to faulty loading in the spine, which causes joint misalignment and results in mechanical musculoskeletal breakdown and then pain, which then results in a further collapsed posture.

A typical treatment for musculoskeletal pain, which is set forth in FIG. 1*b*, utilizes modalities to treat pain from day 1 until discharge. Within the Healthy Posture System, on day 1, exercises are done to improve mobility. Early in the treatment process such as on day 1, exercises are done to strengthen weak muscles. Traditional musculoskeletal treatment processes typically do not include posture education. When the traditional process is complete, the patient is discharged and provided with a home exercise program. A large portion of the patients fail to follow the home exercise program, which results in the patient needing to repeat the program. When using the treatment program of this invention, which is illustrated in FIG. 1*c*, the patient is provided with education on the benefits of healthy posture. The focus on the benefits of healthy posture is continued from day 1 until the patient is discharged from the program. From the start of the program, exercises are done to improve the patient's posture. As the next phase of the program, which typically begins in the second week, the patient is educated on joint clearing techniques. Next, the patient does exercises to strengthen weak muscles. This step is typically begun in week 3. The patient then progresses to a digital maintenance program that includes lifelong fitness coaching.

Healthy joint loading includes the following steps:

1. Restore access to neutral spine alignment in the patient.
2. Condition the patient to perform work tasks from neutral spine alignment.
3. Teach the patient joint clearing techniques before strengthening exercises to maximize the chances strengthening is performed through joints that are not out of alignment.
4. Condition the patient to perform home tasks without faulty loading patterns.
5. Condition the patient to perform fitness without faulty loading patterns.
6. Condition the patient to perform sport and recreational activities from neutral spine alignment.

Bad posture cannot be fixed with a few exercises. The human nervous system requires 6 phases of remodeling to condition itself to function from healthy posture at high levels. Joint clearing techniques are an integral part of the system to break the faulty loading patterns that cause joint misalignment.

This invention helps people with low back, neck, shoulder, hip, and knee pain resolve their issues digitally from the comforts of home. Patients are guided through 6 weeks of digital coaching sessions to safely progress to level 4 of the invention. At this level of neutral spine conditioning, patients are performing their home and work tasks from healthy posture.

An embodiment of this invention is directed to our unique digital physical therapy delivery model using our joint clearing techniques in conjunction with the 6 levels of neutral spine conditioning along with our unique language we have created in best describing how to get into neutral spine alignment aka healthy posture.

The invention utilizes several levels of physical therapy to progressively treat patients, the details of which are set forth below.

Level 1: Functional Mobility Phase

- Functional mobility exercises to restore access to neutral spine alignment.
- Joint clearing technique limited to pelvis self-correction and upper thoracic spine joint clearing technique (Chest Lift Stretch) and upper cervical spine joint clearing technique (Head Nod Stretch).

Level 2: Neutral Spine Integration Phase

Neutral spine integration exercises to restore the ability to maintain neutral spine alignment.

Joint clearing techniques progressed to include upper thoracic spine joint clearing technique (Back Massage) and upper cervical spine joint clearing technique (Neck Massage).

Level 3: Neutral Spine Conditioning Phase

Neutral spine strengthening exercises to restore the ability to maintain neutral spine alignment against light loads.

Joint clearing techniques limited to L5 and C5 self-correction techniques.

Level 4: Functional Conditioning Phase

Neutral spine strengthening exercises to restore the ability to maintain neutral spine alignment against light to moderate loads.

Joint clearing techniques progressed to include L2 and C1 self-correction techniques; 1st rib and fibular head self-correction techniques.

Level 5: Functional Fitness Phase

Neutral spine strengthening exercises to restore the ability to maintain neutral spine alignment against moderate loads.

Joint clearing techniques progress to include shoulder, hip and ankle self-correction techniques.

Level 6: Sport Conditioning Phase

Neutral spine strengthening exercises to restore the ability to maintain neutral spine alignment against moderate to heavy loads.

Over time we realized there was a very consistent patterns for sitting and standing that was driving a consistent joint misalignment pattern. Shifting to the left when sitting and standing (right lumbar loading) was driving a hypermobility of L5 to the left secondary to stretching of the R SI joint ligaments. Collapsed upper back posture associated with this bias to the left was contributing to an elevated right scapula with a right head tilt that had a compensatory upper cervical rotation to the left.

The ramifications of collapsed posture expand beyond mechanical overload and accelerated breakdown of the spine. When we start to load one side of the neck more than the other and we develop head tilt posture. When we start to load one side of the back more than the other, we have collapsed pelvis posture.

In the head tilt posture, the muscles opposite the tilt get mechanically overloaded, anoxic and the end result is muscle pain. The muscles on the side of the tilt are not providing the tension they need to support the shoulder blade and the scapulae floats off the rib cage resulting in shoulder misalignment. This muscle imbalance causes C5 to rotate out of alignment and now the patient is susceptible to nerve entrapment and a bulging/herniated C5 of C6 disc.

In a collapsed pelvis posture, the person stands with his/her right knee bent (flexed). This results in a collapsed right pelvis which causes a functional leg length discrepancy which leads us susceptible to knee and hip pain. At the spine it pulls L5 out of alignment to the left leaving the patient susceptible to nerve entrapment and a bulging/herniated L5 disc.

The invention includes a functional mobility routine to unwind this collapse and joint clearing techniques for the L5 left rotation, C5 right rotation, elevated R scapula and left rotated C1 associated. This is the 10-minute whole body joint clearing. Because some patients are along different levels of collapse and not all patients are right lumbar loaders, the unwinding may be done in both directions.

We can identify the 20% of the patients that are not falling into this pattern and provide them instructions to mobilize the segments that do not allow for full mobility. We have movement screens we use at the onset of each digital coaching session to identify if the patients were successful in administering their prescribed joint clearing techniques before progressing to the neutral spine and functional conditioning exercise. On occasion the entire session is adjusted down to a "restorative session" where we supervise their joint clearing routine.

FIG. 2 includes several images illustrating increasingly greater amounts of posture collapse. In the left most image, the person's spine has a 0 degree of collapse, which is equivalent to a weight of 5 kilograms being placed on the spine. In the next image moving to the right, the person's spine has a posture collapse of 30 degrees, which is equivalent to a weight of 18 kilograms being placed on the spine. In the next image moving to the right, the person's spine has a posture collapse of 45 degrees, which is equivalent to a weight of 24 kilograms being placed on the spine. In the right most image, the person's spine has a posture collapse of 70 degrees, which is equivalent to a weight of 28 kilograms being placed on the spine.

Collapsed posture causes asymmetrical loading through the pelvis in sitting and standing. Asymmetrical loading causes asymmetrical muscle holding patterns. Asymmetrical holding patterns overtime cause joint misalignments in the neck and low back. Joint misalignments cause more asymmetrical muscle holding patterns and nerve compressions. Joint misalignments overtime cause faulty loading in the shoulder, hips, knees, and ankles and this results in joint. The pain causes more faults such as putting pressure on sides of the feet.

If the problem is faulty posture, we simply applied reverse engineering to the problem. The invention utilizes a series of movement educations principles, functional mobility exercises, joint clearing techniques, neutral spine conditioning exercises and functional conditioning exercises medically prescribed in a very structured way to restore movement from healthy posture.

An embodiment of the invention is directed to a medically supervised digital neutral spine-based posture correction system that combines joint clearing techniques with 6 levels of neutral spine conditioning to safely restore a patient's ability to function from healthy posture. Healthy posture is defined as the posture that aligns the pelvis, rib cage and skull in their neutral vertical relationship with each other to maximize facet loading in the cervical and lumbar spine.

Injury prevent is a unique way of combining joint clearing techniques to a workout to ensure that each exercise in the workout strengthens the muscles around the joint symmetrically. Collapsed posture has a predictable effect on the muscle tensions around the shoulder, neck, low back, hip, knees and ankles.

These imbalances cause predictable misalignments at the joints they are designed to move or stabilize. Any exercise performed on a joint that is even slightly out of its neutral position will strengthen the imbalance causing the misalignment. These workouts follow a structure to ensure all exercises are performed with the joints in neutral alignment.

Functional mobility exercise is a series of mobility exercises designed to restore access to neutral spine alignment. The joint clearing technique is a series of joint clearing steps designed to restore neutral joint positioning.

Core screen starts with a series of isometric contractions with the joint in neutral to prepare for safe functional conditioning exercises (neutral reset). Then, the patient progresses through a series of core exercises to determine what level of function conditioning is appropriate. Each workout is dynamic in that the core activation dictates the level of functional conditioning.

The invention is directed to functional conditioning exercises with all the joints involved in the movement maintaining neutral joint positioning throughout the movement to break the faulty loading patterns that's cause pain. This process is necessary for long-term injury prevention through symmetrical conditioning.

The following criteria may be used to evaluate the level of the patient.

| Joint clearing/Joint alignment | L1 | L2 | L3 |
|---|---|---|---|
| Unable to get joint clearing | • | | |
| Able to get joint clearing; unable to get into neutral spine alignment | | • | |
| Able to get joint cleared; able to get into neutral spine alignment | | | • |

| Core Screen | L2 | L3 | L4 | L5 | L6 |
|---|---|---|---|---|---|
| Able to perform pelvic curl single leg (supported) | | • | | | |
| L5/S1 FLEXION OBSERVED | | | | | |
| Able to perform pelvic curl single leg (unsupported) | | | • | | |
| Able to perform pelvic curl from tabletop | | | | • | |

Every session follows this process to ensure the right workout is prescribed.

Additionally, each level of each workout may be observed by trained personnel to ensure safe progression. So, even though level 4 lower body conditioning was prescribed, a patient may be stopped at level 3 lunges if the patient is struggling with them and cannot demonstrate successful completion of the level 3 criteria for progression. Alternatively, the invention may utilize artificial intelligence monitoring.

The following steps are utilized to improve posture consistently and safely using the invention.

(1) Register a unique concept. We have developed 12 joint clearing techniques that restore neutral joint positioning. The program consists of 12 different workouts, 6 upper body and 6 lower body. The joint clearing techniques are built into the workouts.

This is the first medically supervised neutral spine based functional fitness system that includes joint clearing techniques. The joint clearing techniques are performed before strengthening exercise to restore neutral spine positioning so that subsequent neutral spine stability and functional fitness exercises can strength the muscles that ensure symmetrical loading and healthy load transfer.

This process breaks the faulty loading patterns that cause the joint misalignments that serve as the foundation for most musculoskeletal conditions. The invention is a physical therapy model that is 100% organic, requires no modalities, manual therapy, or medication to treat musculoskeletal pain.

(2) Registering unique language. The key to restoring a person's ability to perform their daily activities from neutral spine alignment requires a keen understanding of what neutral spine alignment is, what it feels like to get into it, and a structured system for conditioning the nervous system to function from it.

When in neutral spine alignment, the maximum vertebral body loading at each of the transition joints (L5/S1, T12/L1, C5/6 and C0/1) of the human spine is achieved. Neutral spine alignment distributes the load of the body evenly through each spinal vertebra. Movement of the arms from neutral spine alignment allows for maximum mechanical efficiency through the shoulder and elbow. Movement of the legs from neutral spine alignment allows for maximum mechanical efficiency through the hips and knees.

(3) Teaching how to get into neutral spine alignment. A human must restore access to neutral spine alignment before learning how to maintain it statically or dynamically. The invention utilizes a system of communication for teaching how to get into neutral spine alignment and how to maximize a patient's ability to maintain neutral spine alignment throughout an exercise.

The key to exercises designed to remodel movement patterns is consistency. Each workout video in the program describes how to get into neutral spine alignment using 4 principles. The goal is to ensure the last 4 repetitions of any exercise are performed from neutral spine alignment. This requires timely cueing and consistent language.

(a) A chest lift is utilized to teach a patient how to extend vertebral segments T2-4 (Stack their upper back). It stacks the upper thoracic spine for stronger support of the lower cervical spine. This movement is accomplished by scapular depression through contraction of the lower trapezius muscle. Traditional teaching of healthy upper thoracic spine posture allows for rhomboid requitement that we believe prevents the last bit of upper thoracic spine needed to unload the neck via a head nod.

Forward head posture is not corrected at the neck. The patient must improve upper thoracic spine mobility into extension. Stacking the upper back via a chest lift positions the skull on top of the rib cage. Then a subtle head nod restores neutral positioning of the skull on C1. This restores vertebral body loading through the cervical spine.

All vertebrae are now involved in support and mobility of the skull. The lower trapezius muscle is the muscle predominantly responsible for stacking the upper back by sliding the shoulder blades down the rib cage. There is a misconception the rhomboids play a significant role by pinching the shoulder blades together. This only locks the patient into more forward head posture.

(b) A head nod is when the small skull flexors position the skull in its neutral position on C1. Technology has us spending a majority of our day in collapsed posture. A head nod is not available until T2-4 are in their neutral anatomical position. Because our contemporaries are not achieving neutral upper thoracic spine extension, they likely are not having their patients achieve neutral skull positioning.

Traditional teaching of healthy upper cervical spine posture allows recruitment of multi-segmental neck flexors which inhibits the recruitment of the intersegmental flexors that flex the skull into its neutral position on C1. A head nod restores neutral position of the upper cervical spine allowing for maximum space for the vertebral arteries to pass through, maximizing blood flow to brain. A head nod flexes C5 into a more neutral position restoring vertebral body loading, maximum and symmetrical load transfer through the lower cervical spine.

(c) A tailbone tuck is when the pelvis rotates posteriorly through lower abdominal isolation. It flexes L5 on the sacrum restoring vertebral body loading, maximum and symmetrical load transfer through the lower lumbar spine. This neutral positioning of the lower cervical spine maximizes requitement of the upper abdominals which stabilize the upper lumbar spine in the sagittal plane. It also maximized recruitment of the obliques which stabilize the lumbar spine in the coronal plane.

(d) An inward spiral is when the deep internal rotator muscles internally rotate the femoral head in the acetabulum into its most neutral position. This repositioning of the femoral head into its most neutral positioning restores neutral femoral positioning at the knee which allows for neutral tibial positioning at the knee and neutral tibial and fibulae positioning at the ankle. The inward spiral maximizes symmetry of load transfer through the hips, knees, and ankles.

The last neutral spine principle that helps support the lower abdominals maintain neutral pelvic positioning is an inward spiral of the hips. The inward spiral is when the heads of the femur are positioned in the center of the hip socket (acetabulum) through a subtle internal rotation when the pelvis is in neutral position. The inward spiral restores symmetrical loading through the hips, knees and ankles in addition to supporting neutral pelvis positioning. The patient cannot position the femoral heads into their neutral position in the hip socket when the pelvis is collapses.

(4) Teaching how to maintain neutral spine alignment statically (sitting and standing). A person who has been spending most of each day in collapsed posture for a majority of his/her life will require a few weeks of daily functional mobility exercises to restore the ability to function from neutral spine alignment. The invention includes a movement sequencing that releases the muscles tensions that restrict access to neutral spine alignment. These movement sequences, when followed by joint clearing techniques can restore the functional mobility into neutral spine alignment.

(5) Teaching how to maintain neutral spine alignment dynamically (during movement). A person who has spent a few weeks performing our functional mobility exercises will develop a limited ability to perform daily activities from neutral spine alignment under the appropriate movement supervision. We have developed a system of neutral spine conditioning that safely conditions the human musculoskeletal system to function from neutral spine alignment. When combined with our system of communication outlined above, we can teach humans how to perform daily activities without faulty loading through the spine.

(6) A unique aspect of the invention that differentiates the invention from other injury management and/or injury prevention-based fitness programs is the inclusion of joint clearing techniques into each workout to maximize access to neutral spine alignment before strengthening exercise are performed. Exercise performed with joints out of alignment strengthen the nervous systems strategy for that faulty loading pattern driving that joint misalignment.

To assist the patient in accurately performing the exercises, the invention includes the following videos:

(a) Neck Joint Clearing Video Library.
- Level 1 Neck Joint Clearing-appropriate for muscle tightness but no mobility loss.
- Level 2 Neck Joint Clearing-prescribed when there is mobility loss but no pain.
- Level 3 Neck Joint Clearing-prescribed when there is mobility loss and pain (must be supervised by licensed medical practitioner that has an active injury management certification.

(b) Upper Quarter Joint Clearing Video Library.
- Level 1 Upper Quarter Joint Clearing-appropriate for muscle tightness but no mobility loss.
- Level 2 Upper Quarter Joint Clearing-prescribed when there is mobility loss but no pain.
- Level 3 Upper Quarter Joint Clearing-prescribed when there is mobility loss and pain (must be supervised by licensed medical practitioner that has an active injury management certification.

(c) Back Joint Clearing Video Library.
- Level 1 Back Joint Clearing-appropriate for muscle tightness but no mobility loss.
- Level 2 Back Joint Clearing-prescribed when there is mobility loss but no pain.
- Level 3 Back Joint Clearing-prescribed when there is mobility loss and pain (must be supervised by licensed medical practitioner that has an active injury management certification.

(d) Lower Quarter Joint Clearing Video Library.
- Level 1 Lower Quarter Joint Clearing-appropriate for muscle tightness but no mobility loss.
- Level 2 Lower Quarter Joint Clearing-prescribed when there is mobility loss but no pain.
- Level 3 Lower Quarter Joint Clearing-prescribed when there is mobility loss and pain (must be supervised by licensed medical practitioner that has an active Injury Management certification.

(e) Systems—the Levels of Progression for Each of the 10 Exercises in the Healthy Posture System Serve as Built-In Checks and Balance for Safe Progression.

All scheduling can be completed through the app or the scheduling widget that is embedded on each workout page. Patients are independent in managing their coaching sessions.

Levels of Service (1) Injury severity screen with physical therapist, Doctor of Osteopathic Medicine (DO) or Medical Doctor (MD)

(2) Injury management coaching with a physical therapist or a physical therapist assistant (3) Joint clearing with a physical therapist or a physical therapist assistant (4) Movement education with a neutral spine conditioning specialist Humans can condition themselves to function their daily activities from neutral spine alignment with or without direct contact with a practitioner.

(1) Digital coaching or self-guided for injury prevention such as at a website or using an application installed on a mobile communication device.
  - a. Self-guided-after a posture screen we will allow any patient that can get into neutral spine alignment and denies any pain conditions the ability to purchase a video on demand subscription and guide themselves through the program.
  - b. Digital coaching-after a posture screen we believe the patient requires supervision to perform movement from neutral spine alignment we will recommend:
    - i. Functional Mobility 4-pack or 8-pack to progress to level 3 of the program.
    - ii. Neutral Spine Conditioning 4-pack to safely transition to level 4 of the program.
    - iii. Functional Fitness 4-pack to safely transition to level 5 of the program.

(2) Do-it-yourself physical therapy clinic (aka hands-free brick-and-mortar physical therapy model). A licensed physical therapist or physical therapist assistant is available during business hours to supervise the 20-minute workout session.

An embodiment of the invention is directed to a unique digital physical therapy delivery model using our joint clearing techniques in conjunction with the 6 levels of neutral spine conditioning along with our unique language we have created in best describing how to get into neutral spine alignment aka healthy posture.

Figure 3:
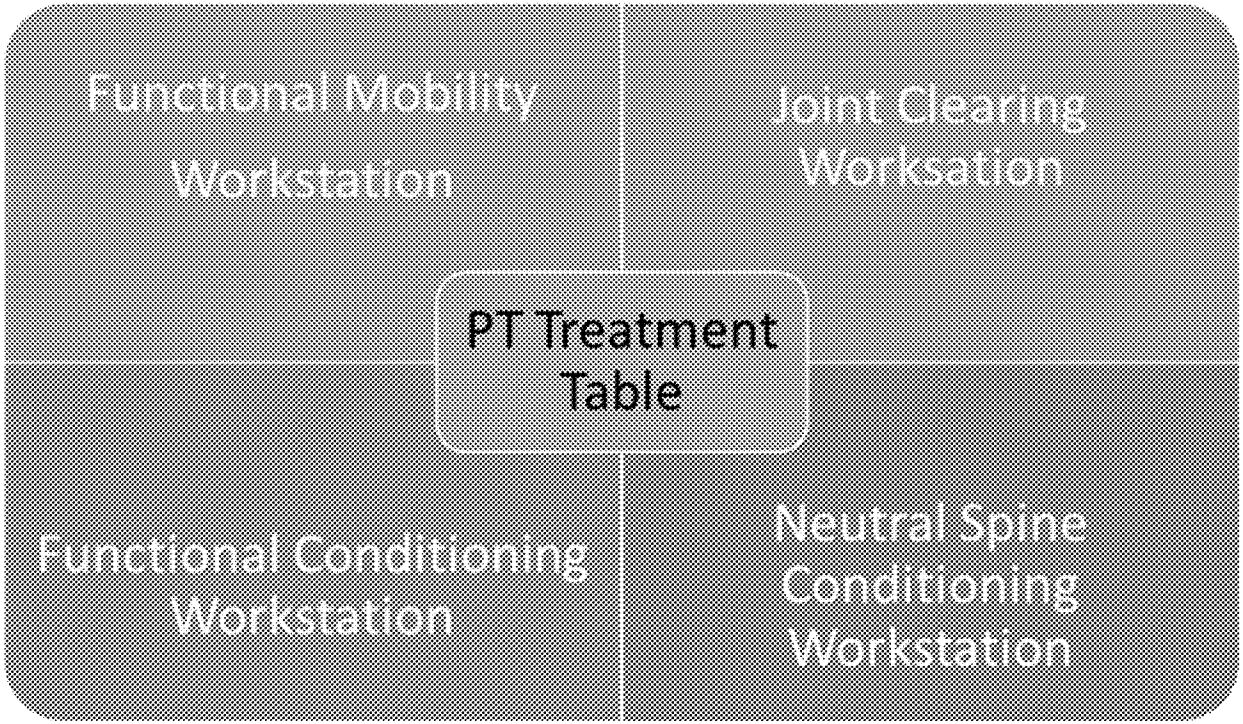
FIG. 3 illustrates a configuration of a do-it-yourself physical therapy center.

As an alternative to a patient using the invention in his/her home, it is possible for the patient to use the invention in a do-it-yourself physical therapy center such as illustrated in FIG. 3. The do-it-yourself physical therapy center can have a relatively small size such as having an area of about 1,200 square feet.

The do-it-yourself physical therapy center may include several workstations that are arranged such as in the order in which the patient would use them. Examples of the workstations include a functional mobility workstation, a joint clearing workstation, a neutral spine conditioning workstation and a functional conditioning workstation. While each of the workstations is illustrated as having a relatively equal size and shape, a person of skill in the art will appreciate that alternative configurations may be used.

The do-it-yourself physical therapy center may also include a physical therapy treatment table that may be used by patients alone or in conjunction with a physical therapist. In certain embodiments, the physical therapy treatment table is positioned approximately in the middle of the di-it-yourself physical therapy center to facilitate the physical therapy treatment table being easily accessed from any of the workstations.

Figure 4:
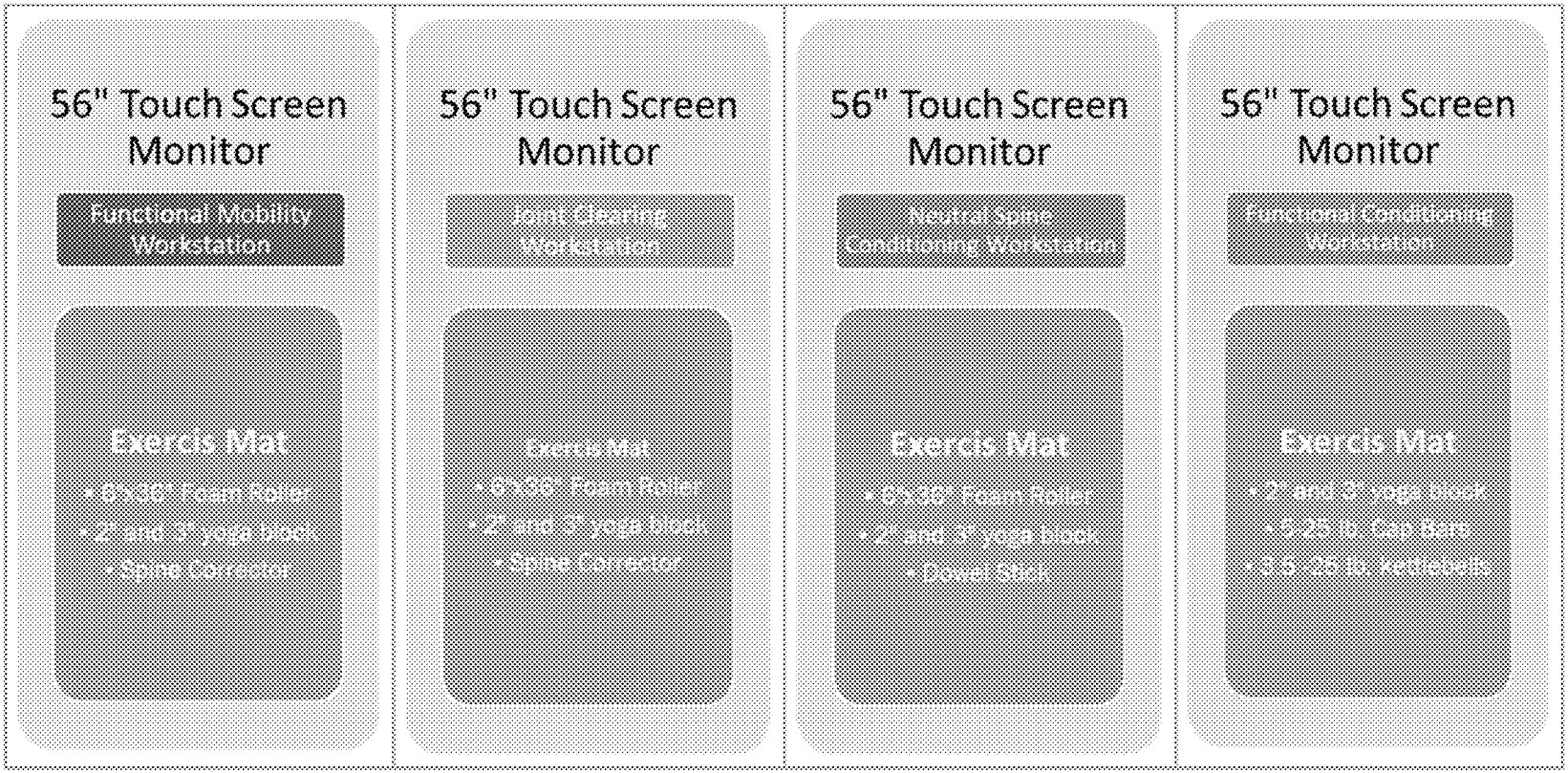
FIG. 4 illustrates four configurations of workstations for use in conjunction with the do-it-yourself physical therapy center.

Each of the workstations may include a relatively large monitor so that the patient can easily view the activities that are being shown to the patient prior to them being done by the patient. In certain embodiments, the monitor has a size of about 56 inches as illustrated in FIG. 4. To facilitate the ability of the patient to interact with the monitor, the monitor may have a touchscreen capability.

The functional mobility workstation may also include an exercise mat, a foam roller such as having a diameter of about 6 inches and a length of about 36 inches, at least one yoga block having a height of about 2 inches or about 3 inches and a spine corrector.

The joint clearing workstation may also include an exercise mat, a foam roller such as having a diameter of about 6 inches and a length of about 36 inches, at least one yoga block having a height of about 2 inches or about 3 inches and a spine corrector.

The neutral spine conditioning workstation may also include an exercise mat, a foam roller such as having a diameter of about 6 inches and a length of about 36 inches, at least one yoga block height of about 2 inches or about 3 inches and a dowel stick.

The functional conditioning workstation may also have an exercise mat, at least one yoga block having a height of about 2 inches or about 3 inches, cap bars having a weight of between about 5 pounds and about 25 pounds and at least one kettlebell having a weight of between about 3.5 pounds and about 25 pounds.

On the initial interaction between the patient and the functional mobility station, the monitor may display a warning to the patient such as "This do-it-yourself treatment model is not designed to help patients recover from surgery, patients with balance loss or neurologic conditions that require balance support. Schedule an injury severity screening if the patient has suffered a set-back or injury since the last physical therapy session."

Figure 5:
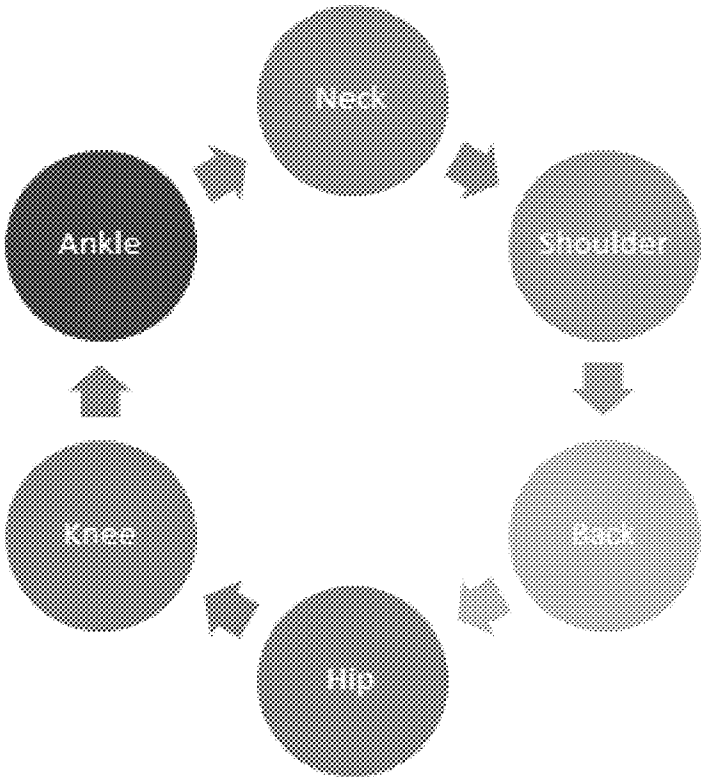
FIG. 5 illustrates different parts of the body in conjunction with the invention can be used.

The system will then display a screen for the patient to indicate the area of the body on which treatment is desired. An example of one such screen is illustrated in FIG. 5, which includes neck, shoulder, back, hip, knee and ankle. The arrows between these parts of the body indicates to the patient that while these are separate parts of the body, they are interrelated.

Figure 6:
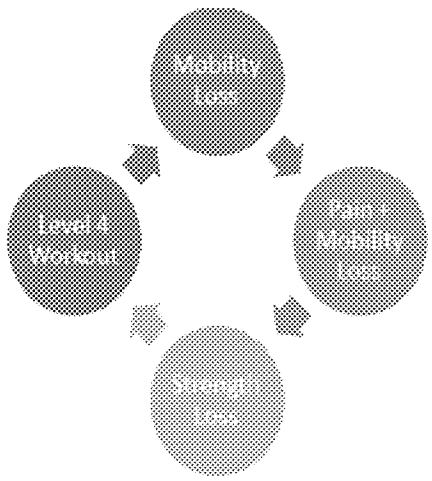
FIG. 6 illustrates conditions that may be treated with the invention.

The system will then display a screen that enables the patient to indicate what the patient wants to accomplish during the physical therapy session, examples of which include mobility loss, pain and mobility loss, strength loss and workout as illustrated in FIG. 6. The arrows between these elements indicate to the patient that while these are separate elements, they are related.

Figure 7:
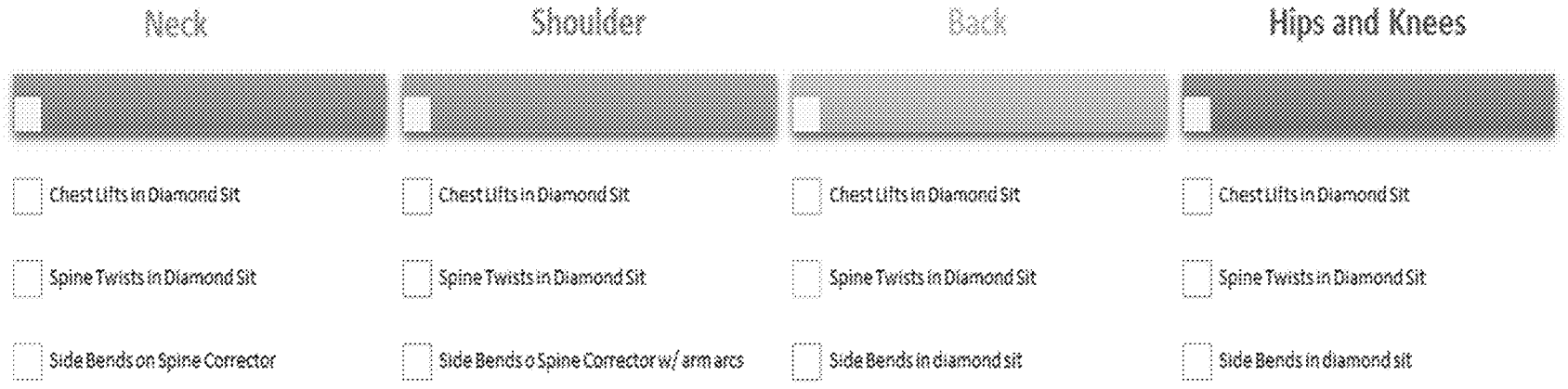
FIG. 7 illustrate the exercises that may be used for different parts of the body.

For mobility loss, the patient can select the level of the functional mobility workout for the selected body part on a scale of between 0 and 10. For pain plus mobility loss, the patient can select the level of the functional mobility workout for the selected body part on a scale of between 0 and 10. For strength loss, the patient can select the level of the functional mobility workout for the selected body part on a scale of between 0 and 10. For the workout, the patient can select the level of the functional mobility workout for the selected body part on a scale of between 0 and 10. Examples of the functional mobility workouts for different parts of the body are set forth in FIG. 7.

Once the patient completes the program at the functional mobility workstation, the system instructs the patient to move to the joint clearing workstation. In certain embodiments, the video for the joint clearing workstation may correspond to the functional mobility video that was just completed by the patient.

Figure 8:
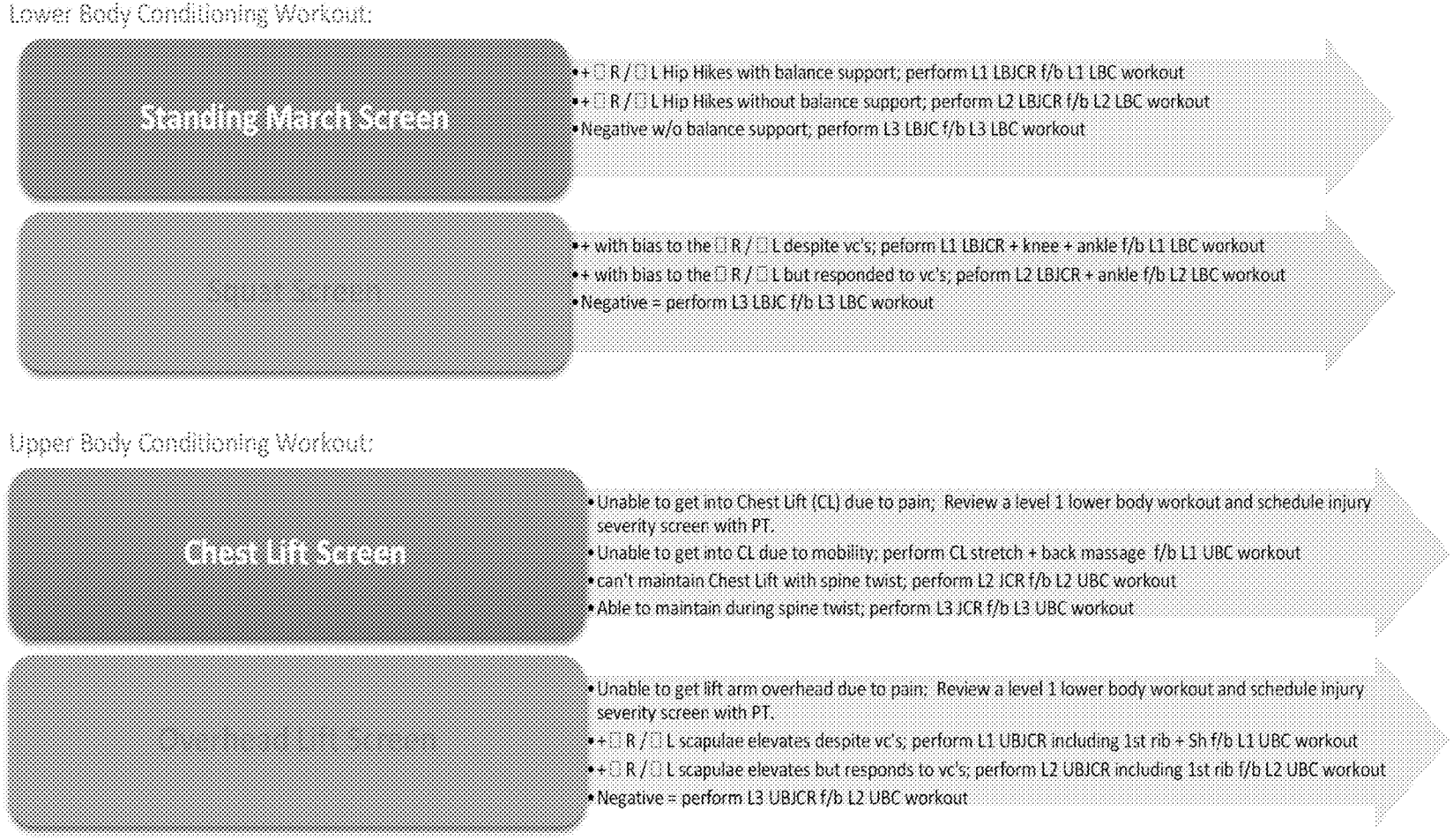
FIG. 8 illustrate the use of the joint clearing workstation in conjunction with lower body conditioning workout and upper body conditioning workout.

The joint clearing workstation may have separate conditioning workouts for the lower body and the upper body as illustrated in FIG. 8. The lower body conditioning workout may be separated into a standing march screen and a squat screen, the details of which are set forth in FIG. 8. The upper body conditioning workout may be separated into a chest lift screen and an overhead lift screen, the details of which are set forth in FIG. 8.

Once the patient completes the program at the joint clearing workstation, the system instructs the patient to move to the neutral spine conditioning workstation. Similar to the joint clearing workstation, the neutral spine conditioning workstation may have separate conditioning workouts for the lower body (FIG. 9) and the upper body (FIG. 10).

In certain embodiments, the lower body conditioning workout includes a series of pelvic curls. Each time the patient does one of the pelvic curls, the patient enters into the system: (1) unable to get into neutral, (2) able to get into neutral or (3) able to flex L5/S1. Entering this information enables the patient to track progress with the physical therapy.

Once the patient's skull and rib are in alignment with each other, the patient needs to position the pelvis in its neutral position via a pelvic curl to better support the lumbar spine. When the patient rotates the pelvis posteriorly, the patient restores vertebral body loading through the lumbar spine. Similar to how a chest lift and head nod restores facet loading in the cervical spine. The lower abdominals are muscle that predominately suspends the pelvis in it neutral position.

The lower body conditioning may also include additional exercises for (1) sacroiliac/hip and (2) knee with each of these options including several activities that are set forth in FIG. 9.

In certain embodiments, the upper body conditioning workout includes a series of planks. Each time the patient does one of the planks, the patient enters into the system: (1) unable to get into neutral, (2) able to get into neutral or (3) able to hold neutral for 8 seconds. Entering this information enables the patient to track progress with the physical therapy.

The lower body conditioning may also include additional exercises for shoulders that includes several activities that are set forth in FIG. 10.

Once the patient completes the neutral spine conditioning workstation, the patient moves to the functional conditioning workstation. Similar to the neutral spine conditioning workstation, the functional conditioning workstation may have separate conditioning workouts for the lower body (FIG. 11) and the upper body (FIG. 12).

The lower body conditioning may include a walking series, a squat series and a lunge series as illustrated in FIG. 11. Each of these series includes a number of activities for the patient to complete.

The upper body conditioning may include a chest lift series, a head nod series and an overhead series as illustrated in FIG. 12. Each of these series includes a number of activities for the patient to complete.

Phases of Progression: All patients start with a posture screen where their primary goals are identified and their level of neutral spine conditioning scored. See metrics below for scoring criteria.

Phase 1 focuses on functional mobility exercise to restore access to neutral spine alignment.

Workout link—Level 1 complete workout page or Level 1 lower body conditioning workout page or level 1 upper body conditioning workout page.

Equipment needed—see equipment needed page.

Ergonomic Adjustment—none.

Phase 1, which typically is done in days 1-3, focuses on functional mobility. This phase consists of exercises to mobilize the upper thoracic spine into extension. Strengthening exercises at this phase will only reinforce faulty loading patterns. Joint clearing techniques will not be successful due to lack of mobility in the motion opposite the misalignment. Typically, patients are not able to maintain neutral alignment for more than a few minutes at this level of neutral spine conditioning.

Phase 2 focuses on neutral spine conditioning exercise to strengthen load tolerance for maintaining neutral spine alignment during static postures. This level of conditioning matches that required for most humans to perform sedentary work tasks without faulty loading when combined with suggested props and individually prescribed ergonomic accommodations. Workstation ergonomic consultation is usually required at this level of conditioning for those that sit and/or stand a majority of their workday.

Workout link—Level 2 complete workout page or Level 2 lower body conditioning workout page or level 2 upper body conditioning workout page.

Equipment needed—see equipment needed page.

Ergonomic Adjustment-raise monitor 4"; start sleeping with body pillow.

Phase 2, which is typically done in days 4-7, focuses on neural integration. Exercise at this level challenge the ability to get into neutral spine alignment in sitting, standing and walking. Strengthening exercises at this phase will still reinforce faulty loading patterns. Level 1 joint clearing techniques can be used to improve mobility in the motion opposite the misalignment. Patients typically can maintain neutral alignment for 5 to 10 minutes at this level of neutral spine conditioning.

Phase 3 focuses on functional conditioning to strengthen load tolerance for performing functional tasks against light load tolerances. Level 3 of the healthy posture system will condition humans how to walk, getting in/out of chair without facet loading in the neck and low back. This level of conditioning matches that required for most humans to perform work and home tasks without faulty loading.

Workout link—Level 3 complete workout page or Level 3 lower body conditioning workout page or level 3 upper body conditioning workout page.

Equipment needed—see equipment needed page.

Ergonomic Adjustment-raise monitor 4"; start using standing desk with saddle stool to allow for supported standing.

Phase 3, which is typically done in weeks 2 and 3, focuses on neutral spine conditioning. Exercise at this level challenge the ability to maintain neutral spine alignment during squatting, lunging and overhead lifting. Functional strengthening exercises at this phase are appropriate, progressive resistive exercises will reinforce faulty loading patterns. Level 2 joint clearing techniques can be used to restore more neutral joint positioning of the upper thoracic spine, the pelvis and L5. Patients typically can maintain neutral alignment for 10 to 20 minutes at this level of neutral spine conditioning.

Phase 4 focuses on functional conditioning to strengthen load tolerance for performing functional tasks against light to moderate load tolerances. Phase 4 of the healthy posture system will condition humans how to pick object from the floor and lift objects overhead without facet loading in the neck and low back. This level of conditioning matches that required for safely return to traditional gym-based fitness programs without faulty loading patterns.

Workout link—Level 4 complete workout page or Level 4 lower body conditioning workout page or level 4 upper body conditioning workout page.

Equipment needed—see equipment needed page. occupation.

Ergonomic Adjustment-based on patient's needs, home environment and

Phase 4, which is typically done in weeks 4 and 5, focuses on functional conditioning. Exercise at this level challenge the ability to get into neutral spine alignment during squatting, lunging and overhead lifting. Progressive resistive exercises can be performed at the level to strengthen the shoulder, hips and knees without faulty loading. Level 3 joint clearing techniques can be used to restore more neutral joint positioning of the lower cervical spine, the shoulder and the knee. Patients typically can maintain neutral alignment for 20 to 40 minutes at this level of neutral spine conditioning.

Phase 5, which is done after the successful completion of phase 4, focuses on functional conditioning to strengthen load tolerance for performing functional tasks against moderate load tolerances. Level 5 of the healthy posture system will condition humans to perform traditional fitness workouts at the gym without faulty loading patterns in the neck and back.

Phase 6 involves mixing things up a bit. At level 6 we teach circuit workouts without breaks and with cardio intervals to add respiratory and circulatory conditioning to their neutral spine based functional fitness workouts. Level 6 of the healthy posture system will condition humans to play sports and recreational activities without faulty loading in the neck and low back.

Close Clinical Observation—each workout series within the healthy posture system has built in levels of safety. If a patient cannot complete 4 repetitions of one level of the exercise, they do not progress to the next level. Additionally, movement screens are performed to ensure the prescribed workout of the day is appropriate. This combined with modification suggestions separates us from any AI product on the market.

Leveling—each patient is leveled based on demonstrated performance during digital workout sessions. This leveling controls the content they are able to access. All workouts are password protected.

Lower Body Conditioning Workout:

Standing March Screen—can patient perform a standing "Captain Morgan" pose (hip flexion to 90 degrees) without losing neutral spine alignment? If yes, then the level of workout remains at the last level the patient was observed to complete 4 perfect repetitions of the healthy walking series. If no, patient is asked to perform low back and/or lower quarter joint clearing techniques if working with a physical therapist or a physical therapist assistant; workout is limited to level 2 or 3 if working with a neutral spine conditioning specialist. Schedule the next digital coaching session with physical therapist/physical therapist assistant if standing march is positive after session.

Positive Test=pelvic hiking observed with and without balance support.

Options:

- If digital workout session is being guided by a physical therapist or physical therapist assistant—see criteria for progress table
- If digital workout session is being guided by a neutral spine conditioning specialist-see criteria for progress table Squat Screen—can patient perform a hip hinge squat without losing neutral spine alignment? If yes, then the level of workout remains at the last level the patient was observed to complete 4 perfect repetitions of the healthy squat series. If not, patient is asked to perform low back and/or lower quarter joint clearing techniques if working with a physical therapist or a physical therapist assistant; workout is limited to level 2 or 3 if working with a neutral spine conditioning specialist. Schedule the next digital coaching session with physical therapist/physical therapist assistant if standing march is positive after session.

Positive Test=unable to squat without shifting to one side.

Options:

- If digital workout session is being guided by a physical therapist or a physical therapist assistant—see criteria for progress table
- If digital workout session is being guided by a neutral spine conditioning specialist-see criteria for progress table Lower Body Conditioning Workout:

Chest Lift Screen—can patient stack the upper thoracic spine to unload the cervical and lumbar spine facet joints dynamically? If not, patient is asked to perform low back and/or neck joint clearing techniques if working with a physical therapist or a physical therapist assistant; workout is limited to level 2 if working with a neutral spine conditioning specialist. Schedule the next digital coaching session with physical therapist/physical therapist assistant if standing march is positive after session.

Positive Test=unable to lift sternum without rib flare.

Options:

- If digital workout session is being guided by a physical therapist or a physical therapist assistant—see criteria for progress table
- If digital workout session is being guided by a neutral spine conditioning specialist-see criteria for progress table Overhead lift screen—can patient lift arm overhead without losing neutral spine alignment? If yes, then the level of workout remains at the last level the patient was observed to complete 4 perfect repetitions of the overhead lifting series. If not, patient is asked to perform neck and/or shoulder joint clearing techniques if working with a physical therapist or a physical therapist assistant; workout is limited to level 2 or 3 if working with a neutral spine conditioning specialist. Schedule the next digital coaching session with physical therapist/physical therapist assistant if Standing March is positive after session.

Positive Test=unable to lift arm overhead with two-part elevation strategy without hiking the scapulae.

Options:

- If digital workout session is being guided by a physical therapist or a physical therapist assistant—see criteria for progress table
- If digital workout session is being guided by a neutral spine conditioning specialist-see criteria for progress table Evaluation of whether the patient has successfully completed the exercises is done as objectively as possible, which is understandably more challenging for when the patient is evaluating performance as compared to when trained personnel are evaluating the performance of the patient.

FIG. 13 includes criteria by which the performance of the patient in completing lower body conditioning for the joint clearing exercises, the neutral spine conditioning exercises and functional fitness exercises. These criteria may include multiple levels that are identified as L1, L2 and L3 such that the performance of the patient can be accurately evaluated at different stages of the physical therapy. These criteria may be displayed while the patient is performing the exercises to facilitate the patient accurately scoring his/her performance.

FIG. 14 includes criteria by which the performance of the patient in completing upper body conditioning for the joint clearing exercises, the neutral spine conditioning exercises and functional fitness exercises. These criteria may include multiple levels that are identified as L2, L3, L4, L5 and L6 such that the performance of the patient can be accurately evaluated at different stages of the physical therapy. These criteria may be displayed while the patient is performing the exercises to facilitate the patient accurately scoring his/her performance.

Metrics for measuring success is neutral spine conditioning scoring chart.

- Level 1-cannot get into neutral spine alignment after joint clearing techniques. Patients must work with a physical therapist/physical therapist assistant to address joint misalignments or neural integration limitations that are limiting access to neutral spine alignment.
- Level 2-able to get into neutral spine alignment after joint clearing techniques; light load tolerance for maintaining. Patient is able to complete a level 2 upper body or level 2 lower body conditioning workout.
- Level 3-able to get into neutral spine alignment after joint clearing techniques; light load tolerance for maintaining. Patient is able to complete a level 3 upper body or level 3 lower body conditioning workout.

Level 4-able to get into neutral spine alignment after joint clearing techniques; light load tolerance for maintaining. Patient is able to complete a level 4 upper body or level 4 lower body conditioning workout.

Results

The healthy posture system will consistently achieve the following milestone with patients that have a healthy nervous system and are compliant with prescribed daily workouts.

Week 1—Understand how to get into neutral spine alignment.

Week 2—able to sit and stand in neutral spine alignment for 25% of day.

Week 3—able to get in/out of chair without faulty loading in the neck or low back; able to sit and stand in neutral spine alignment for 33% of day with recommended props and ergonomic modifications. Able to go up step/curb without asymmetrical loading through hips, knees, and ankles.

Week 4—able to pick light loads off the floor without facet loading in the neck or low back; able to lift very light object overhead without facet loading in the neck or low back. Able to go down step/curb without asymmetrical loading through hips, knees, and ankles.

Week 6—able to pick light-moderate loads off the floor without facet loading in the neck or low back; able to lift light object overhead without facet loading in the neck or low back. Able to go down step/curb without asymmetrical loading through hips, knees, and ankles.

Week 8—able to return to traditional gym-based strengthening and cardio workouts without faulty loading patterns.

Week 12—able to return to sport and recreational activities without faulty loading patterns.

This is the physics of neutral spine alignment and why we can redefine the out-patient physical therapy industry. The physical therapy industry treats the symptoms more often that the problem because those treatments/modalities are the codes reimbursed the higher by third party payors. Those treating posture and joint misalignment do not have a system the combines 6 levels of neutral spine conditioning. Which means that are strengthening on top of collapsed posture which only strengthens the faulty loading patterns that cause musculoskeletal pain conditions.

Chiropractic treats the primary problem but does not pair joint mobilization with posture correction to address the foundation of the problem. The joint clearing techniques within this invention teach patient how to treat themselves. They become very effective at level 4 of the program.

It takes 6 weeks to restore a patient's ability to perform basic daily tasks from neutral spine alignment. It is the most effective way to treat musculoskeletal pain conditions that are associated with collapsed upper back and forward head posture. The invention keeps patients engaged and financially invested in their help for 8.5 months on average. This is on a telehealth dominant platform, client retention could double on a platform that allows for VOD only and video analysis to lower costs.

Another aspect of the invention relates to a smart workout aspect to each workout on that app or DIY terminal. Here is a breakdown of how this functions.

1. Upon login the patient is asked the following 2 questions.
   Does the patient have unobstructed access to neutral spine alignment?
   Does the patient have pain limiting functional mobility?
2. Then the patient is asked to perform 1 of 2 movement screens using motion capture technology.
   Standing march screen for lower body conditioning workouts
   Overhead lifts screen for upper body conditioning workouts
3. Based on response to question 1 and the movement screen, the patient will be provided access to one of the following workouts.
   Restorative Workout.
   Maintenance Workout.
   Progressive Workout Another aspect of the invention relates to a digital physical therapy model that combines weekly online coaching services, with the distributions of the video-on-demand library as well as the "Spine Aligner" stick to help self-care between online coaching sessions. The invention applies reverse engineering to the challenge presented by technological advancements to our posture. If collapsed posture is causing faulty loading patterns which over time cause joint misalignments which cause pain.

Then restoring the ability to function from healthy posture (neutral spine alignment) can restore healthy loading patterns that allow fitness exercises to strengthen the joints that are hypermobile and break the cycle of pain. The invention mastered how to improve posture in 6 weeks with this combination of the video-on-demand library distributed on an individual based on the patient demonstrated abilities during weekly coaching sessions.

The invention can be consumed as a do-it-yourself product for self-care where there is not a do-it-yourself clinic through the purchase of a do-it-yourself subscription. In areas where a do-it-yourself clinic is available, the patients can use these brick-and-mortar locations to consume the product under direct medical supervision.

The invention can also utilize a wearable device with motion capture technology. In one configuration, infrared technology may be used on a dowel stick that is positioned along the spine with some exercises and across the pelvis with other exercises to insure symmetrical loading through the spine and hips during functional strengthening.

This is one mechanism included in the invention to ensure exercises are performed in a way that break the faulty loading patterns that cause the joint misalignments that cause pain. These spine aligner sticks provide tactile as well as verbal feedback during self-care workouts sessions. The spine aligner sticks can be utilized with or without infrared feedback.

A spine aligner stick will vibrate (tactile feedback) when the skull, rib cage or pelvis are not in contact with the stick to alert when the patient is not in neutral spine alignment in the sagittal plane. Infrared feedback requires a hardware purpose and adds verbal feedback to the tactile feedback built into the spine aligner stick. The motion capture technology will provide verbal cues to the patient when they lose neutral pelvis positioning in the coronal (rotational) plane.

In addition to the spine aligner the following resources/technologies are built into the invention to maximize the patient's ability to perform the last 4 repetitions of each exercise within each workout properly. Verbal cues using the invention unique language for teaching healthy posture in the voice over for each workout. Verbal cues for what the patient should feel and where the patient should feel it when an exercise is performed properly.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A healthy posture method comprising:

using a spine aligner stick to evaluate neutral spine alignment, wherein neutral spine alignment occurs when skull, rib cage and pelvis are each in contact with the spine aligner stick, wherein the spine aligner stick provides sensory feedback when the spine in not in neutral spine alignment;

performing joint clearing to attain neutral spine alignment during at least one static posture, wherein neutral spine alignment is where a force of the patient's body is distributed substantially evenly through each spinal vertebra;

strengthening load tolerance by performing functional tasks against light load tolerances;

performing functional conditioning to strengthen load tolerance by performing functional tasks against light to moderate load tolerances; and performing functional conditioning to strengthen load tolerance by performing functional tasks against moderate load tolerances, wherein each step is performed using the neutral spine alignment.

2. The healthy posture method of claim 1, wherein neutral spine alignment aligns pelvis, rib cage and skull in a substantially vertical relationship with each other to maximize facet loading in cervical and lumbar spine.

3. The healthy posture method of claim 1, wherein the healthy posture method improves posture by reducing spinal collapse.

4. The healthy posture method of claim 1, and further comprising performing circuit training to add respiratory and circulatory conditioning to neutral spine based functional fitness workout.

5. The healthy posture method of claim 1, and further comprising displaying an image of a spine in neutral spine alignment and displaying the patient's spine when not in neutral spine alignment and comparing the spine in neutral alignment with the patient's spine not in neutral alignment.

6. The healthy posture method of claim 1, wherein the joint clearing comprises:

performing neck joint clearing;

performing upper quarter spine joint clearing;

performing back joint clearing; and performing lower quarter spine joint clearing.

7. The healthy posture method of claim 6, wherein the neck joint clearing is performed prior to the upper quarter spine joint clearing, wherein the upper quarter spine joint clearing is performed prior to the back joint clear and wherein the back joint clearing is performed prior to the lower quarter spine joint clearing.

8. The healthy posture method of claim 1, wherein the method comprises a chest lift to extend vertebral segments T2-T4, wherein the chest lift stacks the upper thoracic spine for stronger support of the lower cervical spine and wherein the chest lift causes scapular depression through contraction of the lower trapezius muscle.

9. The healthy posture method of claim 1, wherein the method comprises a head nod that restores neutral position of the upper cervical spine allowing for maximum space for the vertebral arteries to pass through and maximizing blood flow to brain, wherein the head nod flexes C5 vertebra into a more neutral position restoring vertebral body loading, maximum and symmetrical load transfer through the lower cervical spine.

10. The healthy posture method of claim 1, wherein the method comprises a tailbone tuck where the pelvis rotates posteriorly through lower abdominal isolation to flex L5 vertebra on the sacrum restoring vertebral body loading, maximum and symmetrical load transfer through the lower lumbar spine to stabilize the upper lumbar spine in a sagittal plane and maximize recruitment of the obliques which stabilize the lumbar spine in the coronal plane.

11. The healthy posture method of claim 1, wherein the method comprises an inward spiral where deep internal rotator muscles internally rotate the femoral head in the acetabulum into its most neutral position to restore neutral femoral positioning at the knee which allows for neutral tibial positioning at the knee and neutral tibial and fibulae positioning at the ankle and wherein the inward spiral maximizes symmetry of load transfer through the hips, knees, and ankles.

12. The healthy posture method of claim 1, and further comprising monitoring the activities using at least one of a trained person or artificial intelligence to ensure that neutral spine alignment is maintained throughout the method.

13. The healthy posture method of claim 1, wherein the spine aligner stick vibrates when there is not neutral spine alignment.

14. The healthy posture method of claim 1, wherein the spine aligner stick utilizes at least one infrared sensor to evaluate neutral spine alignment.

15. A healthy posture method comprising:

performing joint clearing to attain neutral spine alignment during at least one static posture, wherein neutral spine alignment is where a force of a patient's body is distributed substantially evenly through each spinal vertebra;

strengthening load tolerance by performing functional tasks against light load tolerances;

performing functional conditioning to strengthen load tolerance by performing functional tasks against light to moderate load tolerances; and performing functional conditioning to strengthen load tolerance by performing functional tasks against moderate load tolerances, wherein each step is performed using neutral spine alignment; and evaluating neutral spine alignment using a spine aligner stick, wherein the neutral spine alignment occurs when skull, rib cage and pelvis are each in contact with the spine aligner stick and wherein the spine aligner stick provides sensory feedback when the spine in not in neutral spine alignment.

16. The healthy posture method of claim 15, wherein the healthy posture method improves posture by reducing spinal collapse.

17. The healthy posture method of claim 15, wherein the spine aligner stick vibrates when there is not neutral spine alignment.

18. The healthy posture method of claim 15, wherein the spine aligner stick utilizes at least one infrared sensor to evaluate neutral spine alignment.

19. The healthy posture method of claim 15, wherein the joint clearing comprises:

performing neck joint clearing;

performing upper quarter spine joint clearing after performing neck joint clearing;

performing back joint clearing after performing upper quarter spine joint clearing; and performing lower quarter spine joint clearing after performing back joint clearing.

* * * * *